US006027362A

United States Patent [19]

LaCroix

[11] Patent Number: 6,027,362

[45] Date of Patent: Feb. 22, 2000

[54] CONNECTION DEVICE FOR HIGH-DENSITY PARALLEL WIRE ASSEMBLIES

[76] Inventor: Jacques LaCroix, 12 Allee de la Pommeraie - 91570, Bievres, France

[21] Appl. No.: 09/043,794

[22] PCT Filed: Sep. 26, 1996

[86] PCT No.: PCT/FR96/01502

§ 371 Date: Jun. 15, 1998

§ 102(e) Date: Jun. 15, 1998

[87] PCT Pub. No.: WO97/13294

PCT Pub. Date: Apr. 10, 1997

[30] Foreign Application Priority Data

Sep. 29, 1995 [FR] France ..... 95 11457

[51] Int. Cl.[7] ..... H01R 4/24

[52] U.S. Cl. ..... 439/404; 439/417

[58] Field of Search ..... 439/404, 403, 439/405, 417, 427, 393, 888

[56] References Cited

U.S. PATENT DOCUMENTS

| | | | |
|---|---|---|---|
| 3,243,757 | 3/1966 | Cobaugh | 439/888 |
| 3,257,635 | 6/1966 | Cobaugh | 439/888 |
| 3,350,679 | 10/1967 | Marley et al. | 439/888 |
| 3,945,705 | 3/1976 | Seim et al. | 439/403 |
| 4,723,918 | 2/1988 | LaCroix | 439/397 |
| 4,820,191 | 4/1989 | LaCroix | 439/402 |

FOREIGN PATENT DOCUMENTS

| | | |
|---|---|---|
| 2331169 | 10/1976 | France . |
| 2026256 | 1/1980 | United Kingdom . |

*Primary Examiner*—Michael L. Gellner
*Assistant Examiner*—Antoine Ngandjui
*Attorney, Agent, or Firm*—Graham & James LLP

[57] ABSTRACT

The device comprises, mounted on a support base (1), a catch (3) provided with a window (10) for receiving sheathed wires and, mounted on a slide (15) arranged to be moved transversely to the sheathes (32, 33), a clip (17) comprising means (23) for gripping the sheathes (32, 33) of the wires and drawing them towards the bottom (6) of the support base (1) and arranged to cooperate with the catch (3) to strip the wires (30, 31) longitudinally. The reception window (10) of the catch (3) is open to the outside to permit the placing of the wires transversely to themselves and parallel to the relative displacement of the slide (15) and of the support base (1).

10 Claims, 5 Drawing Sheets

CONNECTION DEVICE FOR HIGH-DENSITY PARALLEL WIRE ASSEMBLIES

FIELD OF THE INVENTION

The present invention relates to a device for connecting at least two conductive wires each surrounded by an insulating sheath, comprising, mounted on a support base, a catch provided with a window for receiving the said sheathed wires and, mounted on a slide arranged to be moved transversely to the sheathes, a clip comprising means for gripping the sheathes of the wires and drawing them towards the bottom of the support base and arranged to cooperate with the catch to strip the wires longitudinally.

The device of the invention serves to connect, mechanically and electrically, wires of a plurality of strands or preferably a single strand. It is frequently used in telephone installations.

BACKGROUND OF THE INVENTION

Connection devices of this type are already known, in particular from the French patent 86 15553, published under the number 2 606 558, in which devices the catch is provided with an internal reception window defined by a continuous edge which is closed on itself, to receive the wires after they have been introduced substantially parallel to themselves.

There are circumstance in which the cables have to be introduced substantially transversely to themselves and, moveover, parallel to the relative movement of the clip and of the catch, such as that for which the device of the U.S. Pat. No. 3,945,705 was designed, i.e. for automatic introduction of the cables by placing by machine.

SUMMARY OF THE INVENTION

The present invention aims to propose a device of the type mentioned at the beginning and which is adapted to the automatic placing of wires to be connected.

To this end the device is characterised in that the reception window of the catch is open to the outside to permit the placing of the wires transversely to themselves and parallel to the relative displacement of the slide and of the support base.

The window of the catch is preferably formed between two arms with inwardly turned hooks.

In the preferred embodiment of the device of the invention the catch is a double catch with two opposite reception windows and two clips are provided for gripping and drawing the sheathes and are respectively mounted on two opposite slides arranged to be displaced transversely to the sheathes and towards each other.

In this case, each window can receive only one wire and each clip can comprise only one slot for gripping and drawing a single sheathed wire. However, a pair of clips each opposite to two or more gripping and drawing slots should not for this reason be excluded from the scope of the present application.

In the most interesting embodiment of the device of the invention the support base comprises a plurality of catches and at least one slide carrying a plurality of clips to form a high density wire connecting strip.

The strip is advantageously a strip with double catches and two slides each carrying a plurality of clips for the connection of wires of two wire bundles face to face.

It will be noted that the patent GB-A-2 026 256, which concerns a wire bundle, describes only a connector, or terminal block, connected to this single wire bundle and not a device for connection of two wire bundles.

Each gripping and drawing clip of the device of the invention is advantageously associated with a wire-cutting plate.

It is also advantageous that spacing pieces are provided between a reception catch and a gripping and drawing clip to keep the spacing thereof greater than a cutting threshold.

Also advantageously each clip comprises a diverting projection arranged to cooperate with a double diverting catch mounted on another support base with two opposite reception windows, one to receive the diverting foot and the other to receive at least one other sheathed conductive wire.

A diverting projection of this type can act as a test terminal or contact terminal permitting a so-called full cable diversion.

The two reception windows of the diverting catch preferably extend in two orthogonal places.

The invention will be better understood with the aid of the following description of a double strip for connection-diversion of three high density conductive wire bundles, with reference to the attached drawing in which:

DETAILED DESCRIPTION OF THE FIGURES

Figure 1:
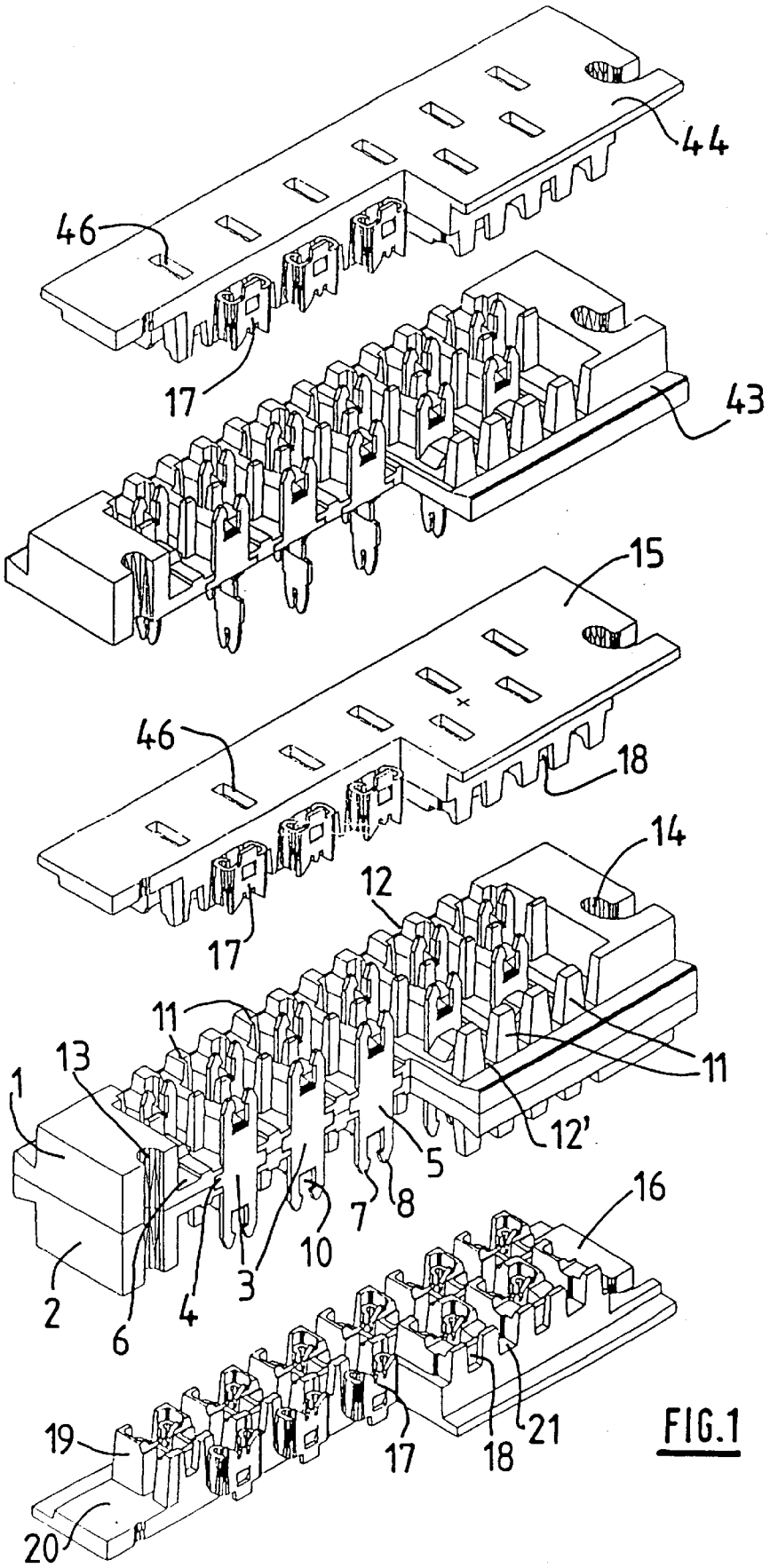
FIG. 1 illustrates an exploded perspective view of the double strip.
Figure 2:
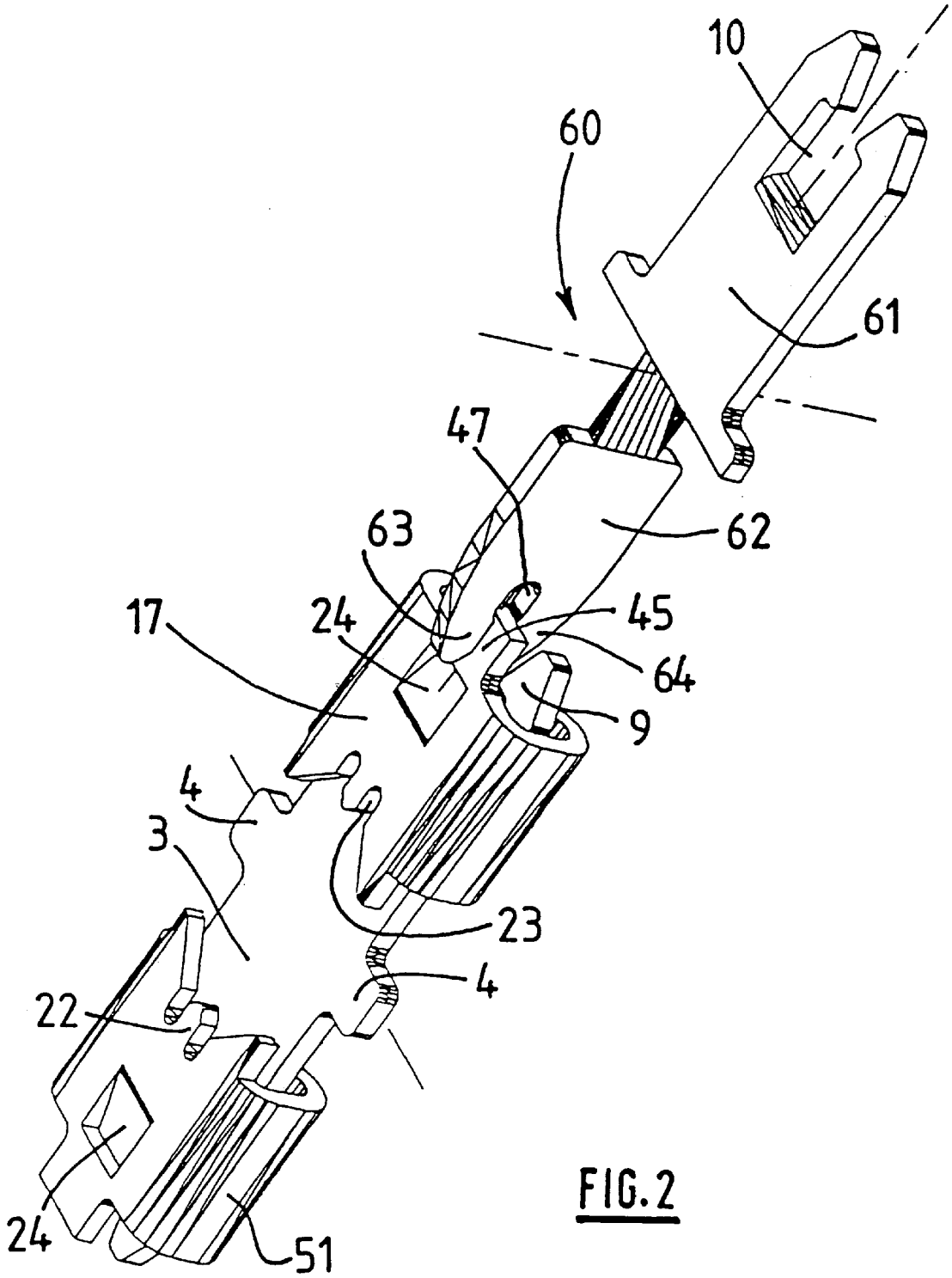
FIG. 2 illustrates a perspective view of a pair of one double connection catch and one double diverting catch of the double strip of FIG. 1.
Figure 3:
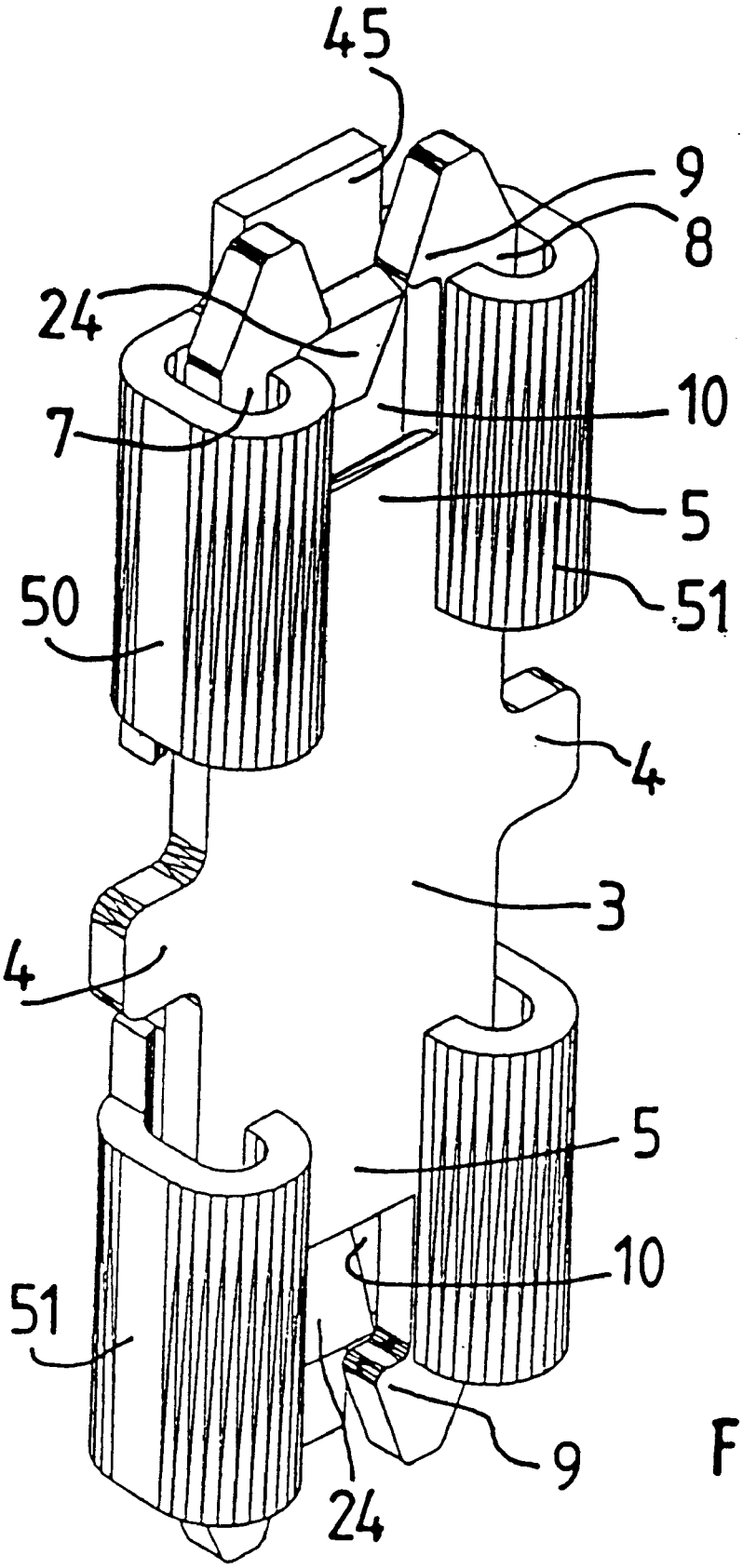
FIG. 3 illustrates a perspective view of the double connection catch of FIG. 2 but from the opposite side.
Figure 4:
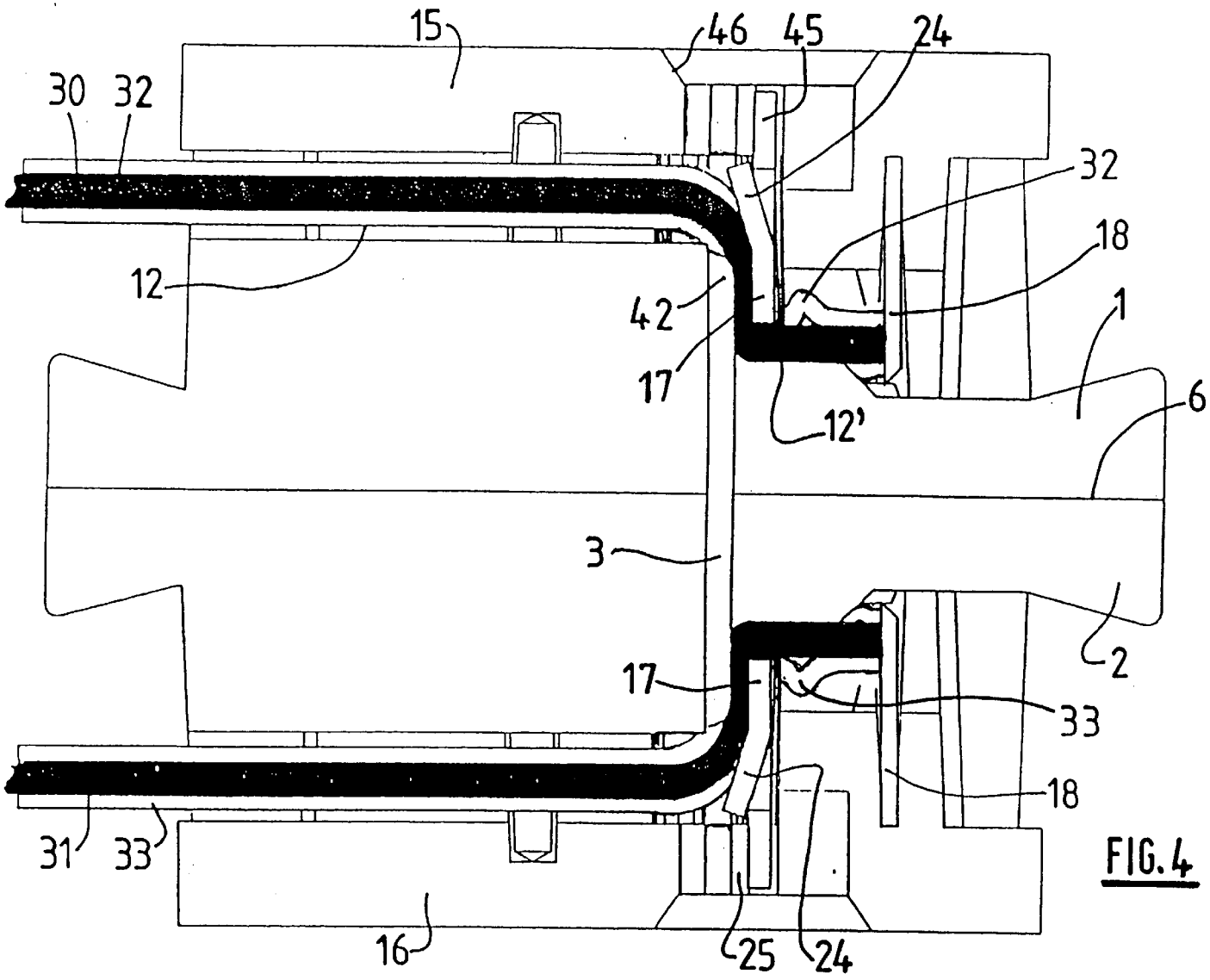
FIG. 4 illustrates a cross-sectional view of the double strip connection part of FIG. 1.

The connection-diversion strip which will be described is intended to connect, by twos, the wires of three sheathed conductive wire bundles with a high density of wires.

The strip comprises a pair of associated support bases 1, 2, in this case formed from insulating synthetic material, carrying and holding between them a plurality of double connection catches 3, made from conductive metal, in accordance with a matrix layout, in this case two rows and six columns.

Each double connection catch 3 is generally in the form of a plate comprising a middle zone, in this case a zone of symmetry, a pair of protruding lateral holding wings 4 which are housed in corresponding recesses in the bases 1, 2 and, at each of the two opposite ends 5, remote from the bottoms 6 of the bases, a pair of arms 7, 8 with inwardly turned hooks 9 and forming between them a reception window 10 which is open to the outside on the side opposite to the bottom 6. The edge 42 of the windows 10, close to the bottom 6, is rounded to avoid possible slicing of the wires.

In the present embodiment each double catch 3 will permit connection of two wires respectively of two of the three bundles and respectively those passed into the two opposite windows 10. Along edges parallel to the rows of catches 3, protruding out of the bottom 6 of each support base 1, 2, are respectively two rows of wire separators 11, forming, between two of them, channels 12 for the passage of the wires and, at the side of one of the two edges, channels 12' for removing cut portions of wires, of which the bottom is closer to the bottom 6 of the slide than that of the channels 12.

The support bases 1, 2 are assembled and fixed to each other in a standard manner. To this end they each comprise bores 13, 14 which also serve to position the strip.

The strip also comprises two slides, or covers, 15, 16, also of insulating synthetic material, each carrying a plurality of clips 15 [sic] and a plurality of wire-cutting plates 18, associated respectively with the plurality of catches 3 with their passage and removal channels 12 in a plurality of connection cells. The clips 17 and wire-cutting plates 18 are forcibly held between pairs of ribs 19 of an appropriate shape, which protrude out of the bottom 20 of each slide 15, 16, and between them form channels 21 for passage of wires and removal of cut portions of wires.

Each clip 17 consists of a substantially rectangular plate of which the narrowest edges 50, 51 have previously been curved by an angle of about 180°, both on the same side. It should be noted that in any case an angle of more than 90° would achieve the function. The diameter of the curves and the thickness of the plate forming a clip 17 are such that this clip can, as will be disclosed later, cooperate, in a nesting manner, with a catch 3. In the same way, each catch 3 can have curved edges, instead of those of clips 17 which would thus be planar but this is a less satisfactory solution.

Each clip 17 comprises, in this case on both sides of a tooth 22, two slots 23 of a width slightly less than the diameter of the core of the wires to be connected. Their height is slightly greater than the diameter of the wire sheath.

Each clip 17 has a lug 24 obtained by embossing, for locking on the associated catch 3 by cooperation of the end of this lug with the lower edges of the hooks 9 of the catches 3. Thus any possible rising of the clips is avoided.

It should be noted that in the connection position of the cells, the lug 24 for locking the clips 17 on the catches 3 extends in the gap 25 separating the clips 17 and the catches 3.

The width of the gap 25, between a clip 17 and a catch 3, is smaller than the diameter of the core of the sheathed wires to be connected and in any case is kept greater than a cutting threshold by two bosses 52, 53 produced by embossing and protruding out of the side 54 of the clip 17 turned towards the catch 3, substantially in line with the curved edges 50, 51 and at the level of the slots 23.

The bosses 52, 53, in this case two in number, are of a substantially rectangular shape but they could be of any other shape.

The function of these bosses 52, 53 is thus that of spacing, i.e. maintaining the spacing between the side 54 of the clip 17 and the catch 3 at least equal to their width, very slightly greater than the theoretical size designated "cutting threshold" with the aim of avoiding cutting the wires. In this respect the bosses are "anti-cutting" bosses.

It will be noted that it would be possible to provide spacing bosses on the catches 3 or even on both the clips 17 and the catches 3.

The bosses 52, 53 have been obtained by positive formation of the clips 17.

Figure 5:
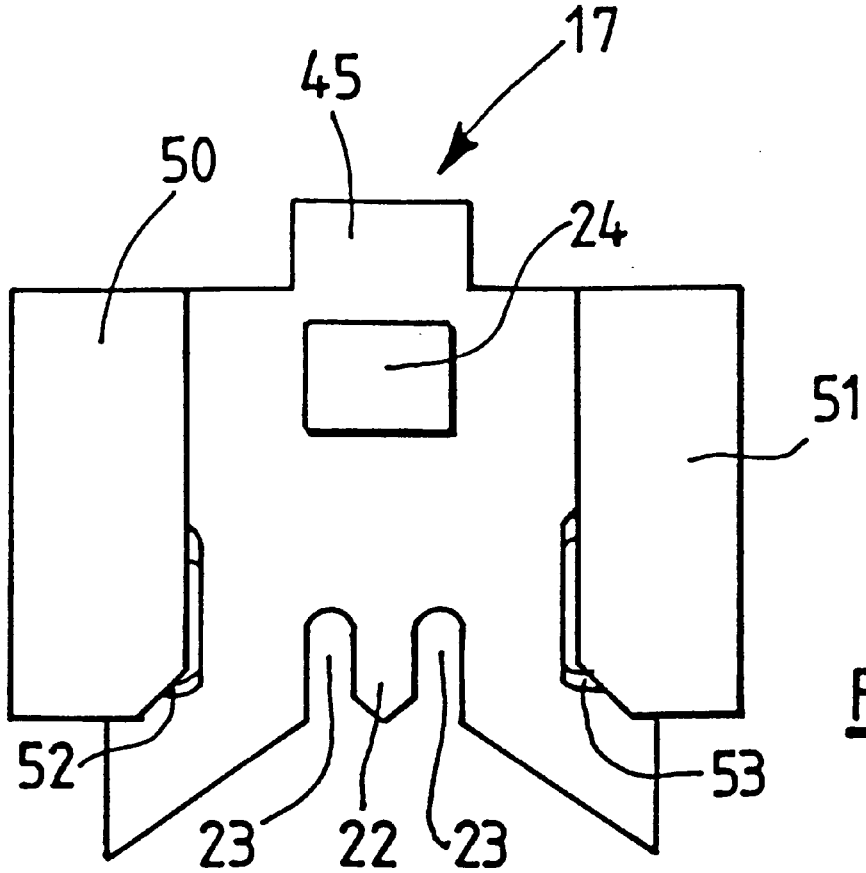
FIG. 5 illustrates a front view of the inside of a gripping and drawing clip.
Figure 6:
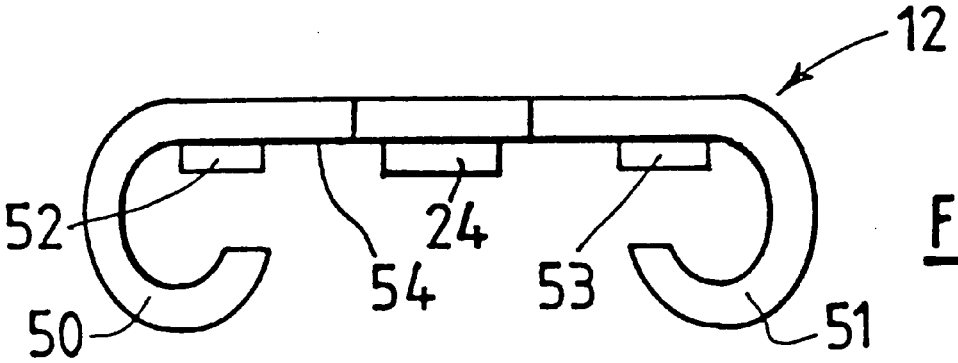
FIG. 6 illustrates a top view of the clip of FIG. 5.
Figure 7:
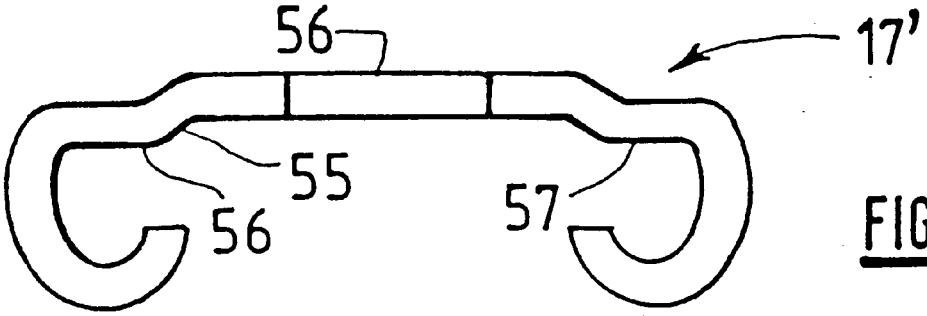
FIG. 7 illustrates a top view of a variation of the formation of the clip.

With reference to FIG. 7, the clip 17' has been embossed to form a groove 55 which is hollow towards the side 56 opposite to the catch 3 and is intended to receive the sheathed wires. In this case it is the lateral edges 56, 57 of this groove which act as anti-cutting bosses or spacing means. This is a negative formation as opposed to the positive formation of the clip 17 of FIGS. 5, 6.

The assembly of this strip part and thus its operation will now be described.

On a special machine the wires 30 of one of the two bundles are placed in the channels 12 of one of the two support bases and they are introduced singly into the first windows 10 of the catches 3. The same operation is carried out with the wires 31 of the other of the two bundles, the channels 12 of the other support base 2 and the second opposite windows 10 of the catches 3.

Then the slide 15, with its clips 17 and cutting plates 18, is placed against the support base 1 and one is forced towards the other by relative displacement transverse to the wires 30 in order finally to press them one inside the other. The same procedure is carried out with the slide 16, the support base 2 and the wires 31.

When the support bases and the slides are being pressed together the clips 17 come to nest with the catches 3, their two curved portions surrounding the catch edges, and to move along the catches 3 parallel to them The slides 15, 16 have been pushed towards the bottom 6 of the bases 1, 2 until a slot 23 in the clips 17, after having gripped the sheath 32, 33 of a wire to be connected and drawn the wire towards the bottom 6 of the base, places the wire in abutment against the bottom of the corresponding channel 12', the clip 17 itself coming into abutment against this bottom of the channel 12', after having forced the wire to pass into the slot 23 completely.

When a wire, gripped in a slot 23, is drawn by the clip 17, it is bent in order substantially to fit to the two surface portions adjacent to the rounded edge 42 of the catch 3. Simultaneously by translation and crushing by reason of the width of the gap 25 which is kept constant by reason of the bosses 52, 53, the wires are stripped over the length between the edge 42 of the catch and the bottom of the channels 12' by lateral plastic flow of the insulator 32, 33.

In the part closest to the bottom of the support bases the clip 17 and the bottom of the channel 12' bend the wires a second time but in the other direction so that once the connection is formed the catch 3, the clip 17 and the bottom of the channel 12' form a chicane for the wire which is thus firmly blocked.

Taking account of the direction of the movement of the clip [sic], the bending angles of the wires are substantially 90° in one direction and the other.

Taking account of the movement of the wires and of the diameter of their core 30, 31, the stripping is achieved by plastic flow of the sheaths 32, 33 in the space 25 between the clips 17 and the catches 3.

At the end of the bending and stripping of the wires, the portions thereof extending into the channels 12' are cut by the cutting plates 18.

Under these conditions the core of the wires 30, 31 of each pair of wires of the two bundles to be connected is in electrical contact with the clips 17 and the catch 3 by means of the portion of its wall extending between the two opposite windows 10; these cores are thus in electrical contact with each other.

The strip of FIG. 1 also makes it possible to connect, in twos, the wires of the bundle extending between the support base 1 and the slide 15 and a third diverting bundle of which the wires are intended to extend between a diverting support base 43 and a third slide 44.

The slides 44 and 15 are, in this case, identical. The gripping and drawing clips 17, on the side opposite to the slots 23 and between the curved edges 50, 51, are extended by a diverting projection 45 which can also act as a test terminal. The diverting projections 45 are accessible via a plurality of apertures 46 provided in the bottom of the clip-carrying slides 15, 16 and 44.

The diverting support base 43, in itself, is identical to the two other support bases 1, 2 described above. Only the diverting catches 60 differ from the connection catches 3.

One half 61 of the diverting catches is in this case identical to the halves of the connection catches 3. The other half 62, the one intended to provide the connection with a clip 17, which is engaged on a connection catch 3, being different. The middle portion of each diverting catch 60 has been machined to cause the connection half 62 to turn by substantially 90°. This connection half 62 ends with a grip having two fingers 63, 64 providing between them a window 47 for receiving a clip projection 45, the two windows 10 and 47 respectively of the two halves 61, 62 of the diverting catch 60 extending substantially in two orthogonal planes.

Once the support bases 1,2 and the slides 15, 16 are assembled, the diverting support base 43 is "plugged in" diverting catches 60 connection portions 62 of the diverting catches 60 engaging in the openings 46 of the slide 15 until the grips 63, 64 grip the clip projections 45 of the slide 15. The connection of the wires of the third bundle is then carried out as previously by placing the wires in the openings 10 of the diverting catches, assembling the slide 44, with its clips 17, with the support base 43 and its catches 60.

What is claimed is:

1. Device for connecting at least two conductive wires (30, 31) each surrounded by an insulating sheath (32, 33), comprising, mounted on a support base (1), a catch (3) provided with a reception window (10) for receiving the said sheathed wires and, mounted on a slide (15) arranged to be moved transversely to the sheathes (32, 33), a clip (17) comprising means (23) for gripping the sheathes (32, 33) of the wires and drawing them towards the bottom (6) of the support base (1) and arranged to cooperate with the catch (3) to strip the wires (30, 31) longitudinally, characterised in that the reception window (10) of the catch (3) is open to the outside on a side opposite to the bottom (6) to permit the placing of the wires transversely to one another and parallel to the relative displacement of the slide (15) and of the support base (1).

2. Device according to claim 1, wherein the window (10) of the catch (3) is formed between two arms (7,8) with inwardly turned hooks (9).

3. Device according to claim 1, wherein spacing means (52, 53; 56, 57) are provided between the catch (3) and the clip (17) to keep the spacing thereof greater than a cutting threshold.

4. Device according to claim 1, wherein the catch is a double catch (3) with two opposite reception windows (10) and two clips (17) are provided for gripping and drawing the sheathes (32, 33) and are respectively mounted on two opposite slides (15, 16) arranged to be displaced transversely to the sheathes (32, 33) and one (15) towards the other (16).

5. Device according to claim 4, wherein each window (10) receives a single conductive wire (30, 31) surrounded by a sheath (32, 33).

6. Device according to claim 1, wherein the support base (1) comprises a plurality of catches (3) and at least one slide (15) carrying a plurality of clips (17), in order to form a connection strip for a high density of wires.

7. Device according to claim 6, with double catches (3) and with two slides (15, 16) each carrying a plurality of clips (17) for the connection of the wires of two bundles of wires face to face.

8. Device according to claim 6, wherein a cable-cutting plate (18) is associated with each gripping and drawing clip (17).

9. Device according to claim 1, wherein each clip (17) comprises a diverting projection (45) arranged to cooperate with a double diverting catch (60) mounted on another support base (43) with two opposite reception windows (10, 47), one (47) to receive the diverting foot (45), and the other (10) to receive at least one other conductive sheathed wire.

10. Device according to claim 9, wherein the two reception windows (10, 47) of the diverting catch (600) extend in two orthogonal planes.

* * * * *